US006886190B2

(12) United States Patent
Tompane

(10) Patent No.: US 6,886,190 B2
(45) Date of Patent: May 3, 2005

(54) DEVICE AND METHOD FOR ALIGNMENT OF DRAINS WITH FINISHED COVERING

(76) Inventor: Don B. Tompane, 2104 Riviera Dr., Vista, CA (US) 92084

( * ) Notice: Subject to any disclaimer, the term of this patent is extended or adjusted under 35 U.S.C. 154(b) by 0 days.

(21) Appl. No.: 10/339,914

(22) Filed: Jan. 10, 2003

(65) Prior Publication Data

US 2004/0111796 A1 Jun. 17, 2004

Related U.S. Application Data

(60) Provisional application No. 60/347,733, filed on Jan. 12, 2002.

(51) Int. Cl.[7] ..... A47K 3/022; A47K 3/34; A47K 3/36

(52) U.S. Cl. ..... 4/612; 4/613; 4/679

(58) Field of Search ..... 4/613, 612, 614, 4/679; 52/34, 35; 210/164

(56) References Cited

U.S. PATENT DOCUMENTS

| | | | | | |
|---|---|---|---|---|---|
| 1,730,455 | A | | 10/1929 | Glauber | |
| 3,744,065 | A | * | 7/1973 | Yavitch | 4/613 |
| 4,261,824 | A | | 4/1981 | Cuschera | |
| 4,541,132 | A | * | 9/1985 | Long | 4/614 |
| 4,883,590 | A | | 11/1989 | Papp | |
| 4,978,250 | A | | 12/1990 | Dallmer | |
| 5,124,031 | A | | 6/1992 | Dallmer | |
| 5,878,448 | A | | 3/1999 | Molter | |
| 6,155,015 | A | * | 12/2000 | Kirby | 52/302.1 |
| 6,175,971 | B1 | | 1/2001 | O'Neill | |
| 6,269,495 | B1 | * | 8/2001 | Sondrup | 4/679 |
| 6,381,775 | B1 | * | 5/2002 | Sondrup | 4/679 |

* cited by examiner

*Primary Examiner*—Henry Bennett
*Assistant Examiner*—Amanda Wieker
(74) *Attorney, Agent, or Firm*—Donn K. Harms

(57) ABSTRACT

An apparatus and method for aligning the exposed drain in finished surfaces in construction with the underlying drains and conduits of the construction infrastructure. The device features an inner generally planar center section, preferably round, with an off center drain aperture communicating between a top surface and a bottom surface. The center section is rotatably in a similarly shaped aperture formed in the surface material surrounding the underlying drain which can also be formed in a surrounding tile to be placed over the drain or in the finished material itself. Once the off center drain aperture is aligned with the underlying drain with the perimeter of the center section aligned with the aperture in the surrounding material, the center section is placed into the similarly shaped aperture and fixed in position with adhesive or grout and the drain strainer may be mounted into the off center drain aperture. The device may be pre manufactured in separate components, kits of separate components, or may be formed using a method of making the components from the tile or finished surface being laid.

18 Claims, 2 Drawing Sheets

DEVICE AND METHOD FOR ALIGNMENT OF DRAINS WITH FINISHED COVERING

This application claims the benefit of U.S. provisional application No. 60/347,733 filed Jan. 12, 2002.

FIELD OF THE INVENTION

The disclosed device relates to drains and their termination above a finished surface. More particularly it relates to a device and method to align a previously buried and stationary drain pipe with the finish surface placed thereover. Such finished surfaces conventionally include ceramic tile, marble, granite, synthetic stone such as CORIAN®, and other decorative and functional surfaces used in showers, sinks, and floors which must be built to communicate with a drain in a sealed engagement.

BACKGROUND OF THE INVENTION

Conventional showers and similar water tight enclosures conventionally are built by first burying a drainage system that communicates with the floor of the shower or other enclosure or surface to be drained of water or other liquid when in use. Similar problems exist with the communication of a drain with a finished floor or patio and also with the communication of ducts from air conditioning and the like with finished wall and floor surfaces.

The problem with drain and duct alignment with finished surfaces continues to be vexing and in the case of new construction is generally left to the last person working on the project who is in charge of finishing out the final surface and mating it to the underlying surface and drain.

During construction or remodeling work associated with a home, office building, or any other type of habitable structure, there are many different tradesmen involved from the start of the project to its completion. Typically, when it comes to a project nearing completion, the tile setter is one of the last craftsmen to be involved and the first to be blamed for a poor result. Because the tile setter's expertise is one of the last talents employed, his ability to produce a high quality, finished product, is closely related to the quality work that has been done before him and the adherence to specifications and standards by the workers preceding him.

Generally, after leveling of the construction site has been accomplished, installation of the concrete foundation for the project is the first major evolution. Along with the concrete work, plumbers are involved to ensure that all necessary piping is in place to support plumbing needs for the project. The plumbers must lay out their piping in strict accordance with approved plans in order to facilitate the proper alignment of plumbing fixtures such as drains and faucets that will be installed later on during the course of the project.

Following the layout, concrete work, and initial plumbing installation, the framing crew becomes involved. They are responsible for the development of the basic structure and the partitioning of the rooms, as they will eventually exist in final form. Hand-in-hand with the construction-framing process, the plumbers are once again involved in the layout of necessary internal plumbing in the walls and floors to support the finished fixtures and drains envisioned in the finished project. Additionally, electricians will install all necessary electrical fixtures and wiring to support the structure.

Finally, after all of the basic construction has been completed, including the concrete, plumbing, and electrical work, the finish work begins. Finish work includes putting the 'finishing touches' on the completed base project. This may include floor covering installation, placement and hookup of appliances, finish carpentry, HVAC (heating, ventilation, and air conditioning), internal and external painting, and tile work. It is the tile setter, however, may run into the most vexing problem during this phase of the construction.

If the tile setter is creating a custom bathroom shower, for instance, the proper and aesthetic completion of his work inevitably depends from the proper layout of the pre-installed plumbing beneath the shower by his predecessor on the job. The available drain opening in the shower floor must ultimately align with the exposed drain and strainer at the finished surface level, to produce an aesthetically pleasing and functional installation. Given all the tradespeople involved in the construction effort, the available drain opening in the shower floor and the existing plumbing, do not always align properly. While this misalignment is usually very small by measurement standards, a misalignment of a quarter of an inch can be significant during the drain installation and can affect the overall appearance of the finished tile job. Such misalignment has resulted in many wasted hours of a highly skilled tile setter's time in remedying the sins of the plumber and concurrently producing a finished surface such as tile, that is well laid out and aesthetically eye pleasing.

Since accepted industry practice is to leave the solution for any misalignment caused by plumbers or carpenters in earlier construction to the skills of the tile setter, the setter must employ various creative efforts to resolve alignment problems while still making the best use of the tile or other surfacing to be used in the final covering.

Current technology provides for the use of a "trim frame" normally made of stainless steel, which is designed to be installed into an opening cut into a 4¼ inch piece of standard tile. The trim frame is positioned around the drain opening and provides a straight surface for the union of the trim frame and adjacent tiles in order to provide a finished look to the tile/drain interface. The trim frame is the only standard, uniform appliance that is currently manufactured to provide a proper fit-up between the tiled surface and the installed drain piping.

With the tile industry is currently in a growth phase. As a result, consumers are demanding more and better products, making it imperative for manufacturers to seek better methods and techniques to solve industry problems. The lack of available substitutes for the antiquated and inadequate trim frame is an industry problem that to date has been unsolved and has required the use of highly skilled tile setters and surfacing finishers to solve misalignment problems and increased the cost of labor on job sites.

As such, there is a pressing need for an interface device and a method, that will allow a surfacing finish to be more easily aligned with the underlying drain opening in a shower as in ceramic tile or stone. Such a device could also be used in differing embodiments to align drains and/or other conduit type underlying structures such as ventilation ducts and floor drains with underlying infrastructure and yield a smooth, fluid tight, and ascetically pleasing appearance. Such a device should be useable by those less skilled in the finishing trade to accomplish the sometimes daunting task of drain and conduit alignment and thereby decrease labor costs and allow the more seasoned journeymen to use their skills on projects requiring them. Such a device should also be able to be produced on the site by a method which with conventional or specialized tools to yield a functioning device when manufacturing or dye lots or other aesthetic matters require the manufacture of the device from the material being laid at the time.

SUMMARY OF THE INVENTION

The above problems, and others are overcome by the herein disclosed method and an apparatus for alignment of underlying drains and conduits with the finished drain and strainer in the finished covering such as tile, stone, plastic, and synthetic laminate surfaces. The device operates by providing an aperture for placement of the strainer and conventional trim frame in the finished surface in a surface drain opening formed in a center section that is rotatable and mateable to a formed opening in the surface of the finished material which overlaps the underling drain. Because of the off center drain opening, rotating the center section acts as an eccentric allowing an infinite number of possible mating positions for location of a finished drain opening in the finished surface above the prior installed drain or conduit located below the surface. Should the finished surface be of a material that is custom or does not have the disclosed device already manufactured for installation, the device may actually be formed by a method which uses the existing finish surface material to form the rotating center section to allow for lining up of the underlying drain with the custom finished surface.

As herein disclosed as a device for use with ceramic or similar conventional tile, the device features a planar rotating tile having a top surface and bottom surface. Communicating between the top surface and the bottom surface is a generally circular drain aperture which is placed off center from the center point of the circular or other shaped rotating tile.

In this most basic embodiment of the device, the rotating tile would be generally round in shape and placed in a circular opening sized to accommodate its circumference and formed around a preexisting drain aperture. The rotating tile would then be rotated in the circular opening until the center of the drain aperture is in substantial alignment with the center of the underlying drain.

This most basic embodiment would involve a few steps of a method to achieve this alignment in that the user would need to place the surrounding tiles around the underlying drain and form the circular opening in those tiles to generally surround the underlying drain. Then the user would insert the round tile into the circular opening and rotate the tile until the drain aperture lines up with the underlying drain. While not yielding the utility of the best and preferred embodiment of the device, this method and simple embodiment is a major step over conventional drain and tile alignment.

In the preferred embodiment of the device, a surrounding planer tile is used that is generally rectangular in shape matching the color, texture, and shape of the rest of the tile used for the final surfacing for the best aesthetic result. While this specification directs the invention to tile, to those skilled in the art, it will be obvious that the device and method could also be used with granite, stone, and synthetic stone or other such surfacing with equally good results.

The surrounding tile has an upper surface and a lower surface and a circular passage having a sidewall communicating between the upper surface and lower surface of the surrounding tile. This circular passage in the current best mode is placed off of center from the center point of the surrounding tile pieces. This off center placement allows the surrounding tile piece to be rotated in its positioning over the underlying drain to place the circular passages in a plurality of different positions in which it surrounds the underlying drain. This rotation ability of the surrounding tile with an off center aperture provides a first means for rotational adjustment to align the drain opening with the underlying drain. As is clear, some positions will be more off center from the underlying drain than others yielded by rotating the surrounding tile in its final placement.

Once the surrounding tile has been initially placed to its position where the circular passage surrounds the underlying drain in a desired position, a planar rotating inner tile is placed in the cooperating aperture formed in the surrounding tile and which surrounds the underlying drain. The current best mode features both a round inner tile and a round aperture sized for rotational engagement with the circumference or perimeter of the inner tile. However those skilled in the art will realize that other shapes could be used as long as the inner tile rotates and engages along its outside surface or perimeter with the cooperating aperture in the surrounding tile. Consequently such other shapes are anticipated. Once inserted into the co-operating aperture, the rotating tile would then be rotated in the circular passage until the center of the drain aperture in the rotating tile is in substantial alignment with the center of the underlying drain.

As can be seen, the placement of the drain aperture in position over the underlying drain is infinitely variable by the off center placement of the cooperating passage in the surrounding tile by rotating the surrounding tile, and, the off center placement of the drain aperture in the rotating tile which then rotates in the off center placed circular passage. Of course the device might be also made with the cooperating passage of the surrounding tile centered and then relying on the rotation of only the rotating tile to yield drain and drain aperture alignment but this would yield less ability to adjust the position of the drain aperture. Also, when large quantities of a certain tile color or style are manufactured, a kit of different shaped or sized rotating tiles of the same color or pattern with differing off center placement of the drain apertures could be provided with both the off center version of the surrounding tile and the centered circular passage of the surrounding tile to give the installer great variance and adaptability in installing the final surface and mating it to the underlying drain or conduit.

Additional features of the disclosed device would allow even more utility and additional function to the finished product. One such feature would be shaping the top surface of the rotating tile and/or the surrounding tile if used, in a concave fashion such that the lowest point of the top surface of the rotating tile would be at the center of the drain aperture therein. This would enhance drainage of fluid once the rotating tile is set in place in the cooperating aperture and grouted.

Another optional would be a means to engage the side edge of around the outside perimeter of the rotating tile in cooperative engagement with the circular passage of the surrounding tile. This could be done in a number of fashions including the placement of a ledge around the perimeter of the circular passage which engages the bottom or a relief in the perimeter of the bottom surface of the rotating tile. Or, a raised edge along the outside perimeter side edge of the rotating tile could engage with and rotate in a notch formed on the inside edge of the circular passage. Or some other means for cooperative registered rotational engagement could be used to allow the rotating tile to rotate in registered cooperative engagement with the circular passage.

Finally, the inner planar component might be formed of one or a plurality of rings and circular shaped or otherwise rotatable components which will all rotate in relation to each other giving the device even more adjustment ability by the ability to rotate one, two, three, or more components in relation to each other.

Accordingly, it is the object of this invention claimed herein to provide a simplified device for the application and alignment of finished surfaces over underlying drains and conduits.

It is an additional object of this invention claimed herein to provide a method for making the device for alignment of finished surfaces over underlying drains and conduits should on site manufacture be more convenient.

It is another object of this invention to supply a tile or finished surface component which may be easily aligned with the underlying drain by simple rotation of the tile in its engagement with surrounding tiles.

It is still another object of this invention to supply an inner tile and surrounding tile which allow for cooperative registered rotational engagement of the inner tile with the outer tile.

It is a still further object of this invention to provide for the elimination of problems inherent with current alignment of the final surface covering with underlying drains.

Further objectives of this invention will be brought out in the following part of the specification, wherein detailed description is for the purpose of fully disclosing the invention without placing limitations thereon.

BRIEF DESCRIPTION OF THE DRAWING FIGURES

The accompanying drawings which are incorporated in and form a part of this specification illustrate embodiments of the disclosed processing system and together with the description, serve to explain the principles of the invention.

DETAILED DESCRIPTION OF THE PREFERRED EMBODIMENTS OF THE DISCLOSED DEVICE

Figure 1:
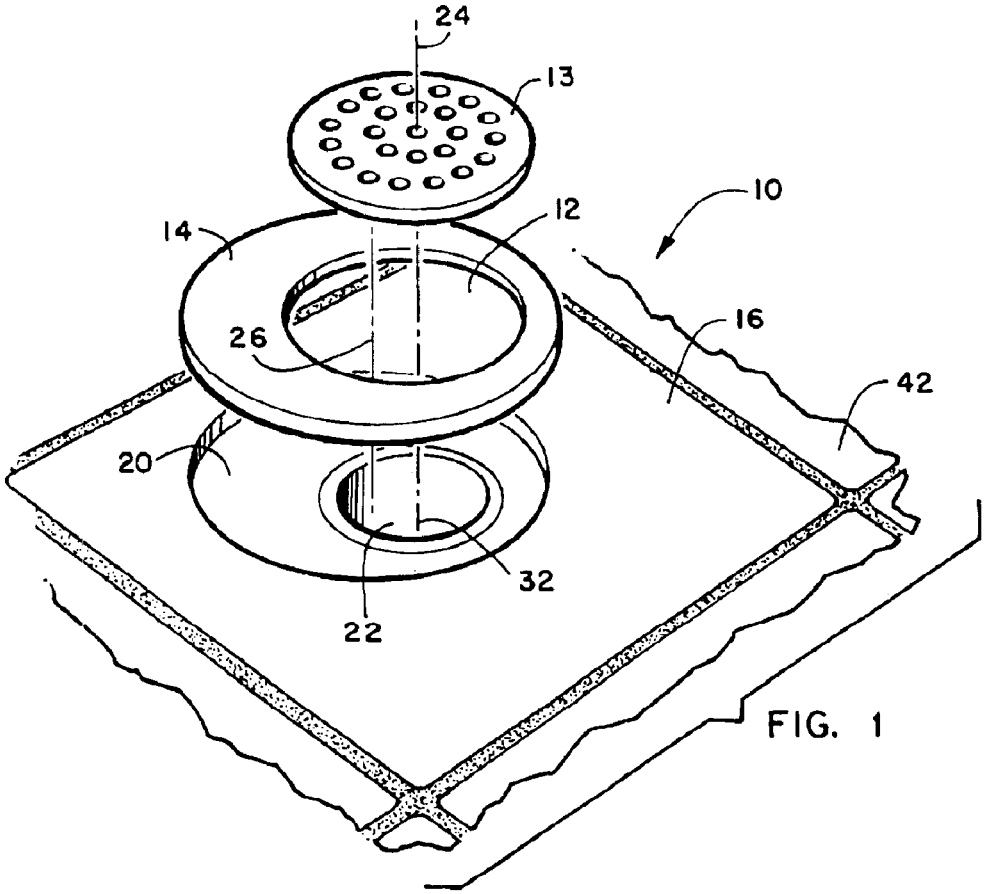
FIG. 1 depicts an exploded view of the preferred embodiment of the disclosed device showing the rotatable inner tile component with an off center aperture which cooperatively engages with a formed passage of a surrounding surface in a tile.
Figure 2:
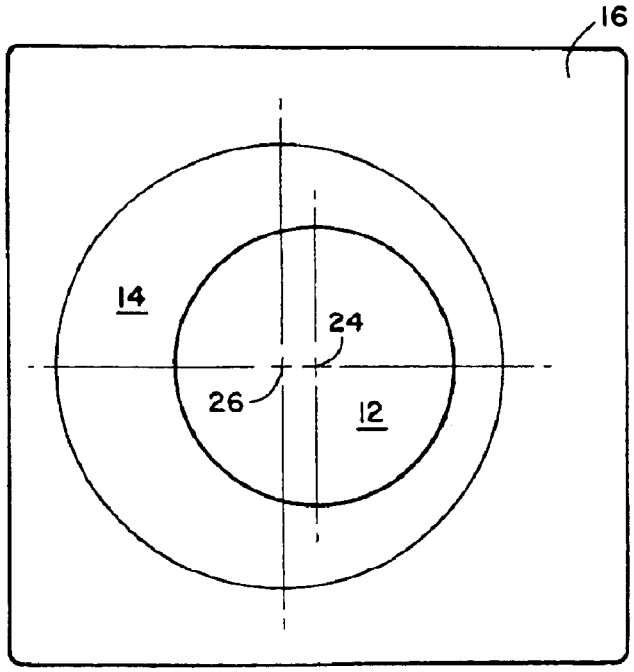
FIG. 2 depicts a top view of the device in FIG. 1.
Figure 3:
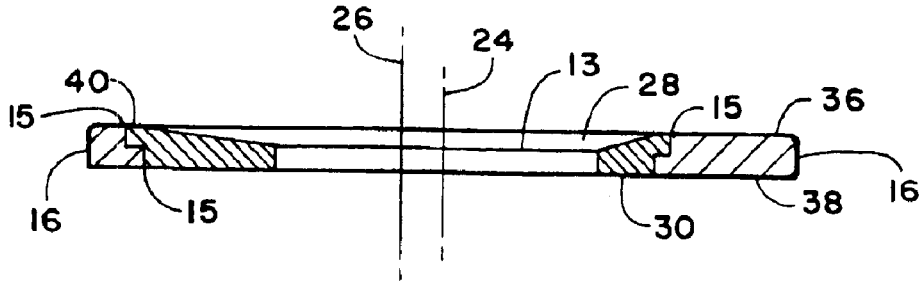
FIG. 3 depicts a side view of the device of FIGS. 1 and 2 and shows the formed recess in the top surface of the rotating tile.

Referring now to the drawings of the device 10, in FIGS. 1–4, FIG. 1 depicts a first preferred embodiment of the disclosed device 10 showing the components thereof formed and in exploded form. The device 10 operates to position the finished surface drain opening 12 communicating through a generally planar center section 14 which is rotatable and cooperatively engageable in a formed opening 20 communicating through the generally planar surrounding section 16 which forms the surface of the finished material which surrounds the underling drain 22. The surface drain opening 12 would be sized to accommodate the strainer 13 and underlying drain trim that is used to mate to the underlying drain 22.

It should be noted that while the center section 12 is depicted as round in the current best mode, other shapes such as ovals or stars, squares, or notched circles engaged in a notched opening, would work as long as the center section 12 may be rotated and then engaged in position in the formed opening 20 in the surrounding section 16 and thereby realign the surface drain opening 12 with the underlying drain 22. Further, while the surrounding section 16 is shown as rectangular, it might also be round or other shapes that would be rotatable and inserted into a similarly shaped aperture in the finished surface that is slightly larger. All such modifications as to different shapes for the rotating center section 14 are thus anticipated and this disclosure depicts the center section 12 which rotates as round in shape as the current best mode, since it has been found that a round shaped center section 14 in a round formed opening 20 offers an infinite number of positions for rotation of center section 12. There are also round rotating saws available to craftsmen to use the claimed method herein to manufacture the components easily on the job site and thus round shapes are better accommodated by the installed base of tools used by such craftsmen.

In use, rotating the center section 12 of the round embodiment depicted, acts as an eccentric allowing an infinite number of possible mating positions for location of the finished surface drain opening 12 to align with the underlying drain 22. This would of course be the case with other shapes that might be rotatable and inserted back into a similarly shaped slightly larger formed opening 20 so long as the drain opening center point 24 of the surface drain opening 12 is formed off center from the center section center point 26 and may be rotated and then inserted into the formed opening 20. Once aligned and inserted into the formed opening 20 the center section 14 would be fixed with adhesive or grout or other conventional means of adhering the finished surface to the underlying surface.

Normally the device 10 would be pre manufactured with the two components in colors and textures to match the commercially available tile and finished surfaces that would surround the underlying drain 22 in showers, bathrooms, sinks and the like. However, should the finished surface surrounding the underlying drain 22 be of a material that is custom or does not have the disclosed device already manufactured in components for installation, the device may actually be formed by a method of, taking a portion of the existing finish surface material being used to form the surrounding section; cutting the formed opening into the surrounding section; from the existing finish surface material being used, cutting a center section sized to cooperatively engage with the formed opening; and cutting the surface drain opening off center from the center point in the center section. This could easily be done by craftsman in the filed using standard saws, hole saws, and similar conventionally used tools and would provide the two basic components in material matching that being used.

As herein disclosed as a device for use with ceramic or similar conventional tile or finishing materials, the device 10 features a generally planar, rotatably mountable, center section 14 having a top surface 28 and bottom surface 30. Communicating between the top surface 28 and the bottom surface 30 is the surface drain opening 12 which is as noted has a drain center opening 24 placed off center from the center section enter point 26. With the surrounding section 16 positioned or mounted to place the formed opening 20 to surround the underlying drain 22, the center section 14 would then be rotated until the drain aperture center point 24 is in substantially alignment with the drain center point 32 of the underlying drain 22. Once so aligned, the center section 14 may be glued or grouted into place in the formed opening 20 and the strainer 13 installed for a neat and substantially leak proof installation.

In one current preferred embodiment of the device 10, the surrounding section 16 of tile is used which is generally rectangular in shape since conventionally tile is manufactured in square or rectangular pieces. As noted above, while this specification directs the device 10 to a tile installation, to those skilled in the art, it will be obvious that the device and method could also be used with granite, stone, and synthetic stone or other such surfacing with equally good results, and the surrounding section 16 may be a separate component in the best mode or might simply be the finished surface 42 continued up to the formed opening 20 as a unitary structure shown in FIG. 2.

The surrounding section 16 has a top surface 36 and a bottom surface 38 with the formed opening 20 communicating therebetween. As shown, the formed opening is circular in shape to engage the exterior circumference of the center section 14 which is circular. This formed opening 20 in the current best mode is placed off of center from the center point of the surrounding section 16 which allows the surrounding section to be rotated in its positioning with the adjacent finished surface 42 and over the underlying drain to place the formed opening 20 in a plurality of different positions in which it surrounds the underlying drain 22. This rotation ability of the surrounding section 16 with the off center formed opening 20 provides a first means for rotational adjustment to align the surface drain opening 12 with the underlying drain 22.

Once the surrounding section 16 has been positioned where the formed opening 20 surrounds the underlying drain 22 in a desired position, the center section 14 is cooperatively engaged in the formed opening 20 and rotated to align the drain opening center point 24 with the center section center point 26.

An additional preferred but optional feature of the disclosed device provides more utility to the current best mode. As seen best in FIG. 3, shaping the top surface 28 of the center section 14 in a concave fashion such that the lowest point of the top surface of the rotating tile would be at the drain opening center point 24 enhances drainage of fluid once the center section 14 is set in place in the cooperating formed opening 20 and grouted. If the two component system is used the surrounding section 16 can also have a concave top surface 36 and this would be preferable in many tile and grout installations to insure excellent drainage.

Another optional would be a means to engage the side edge 15 around the outside perimeter of the rotating tile in cooperative engagement with the circular passage of the surrounding tile. This could be done in a number of fashions including the placement of a ledge 40 around the perimeter of the formed opening which engages a cooperating ledge 40 on the perimeter of the co-operating center section 14. Or, a raised edge along the outside perimeter side edge of the rotating tile could engage with and rotate in a notch formed on the inside edge of the circular passage. Or some other means for cooperative registered rotational engagement could be used to allow the rotating tile to rotate in registered cooperative engagement with the circular passage.

Figure 4:
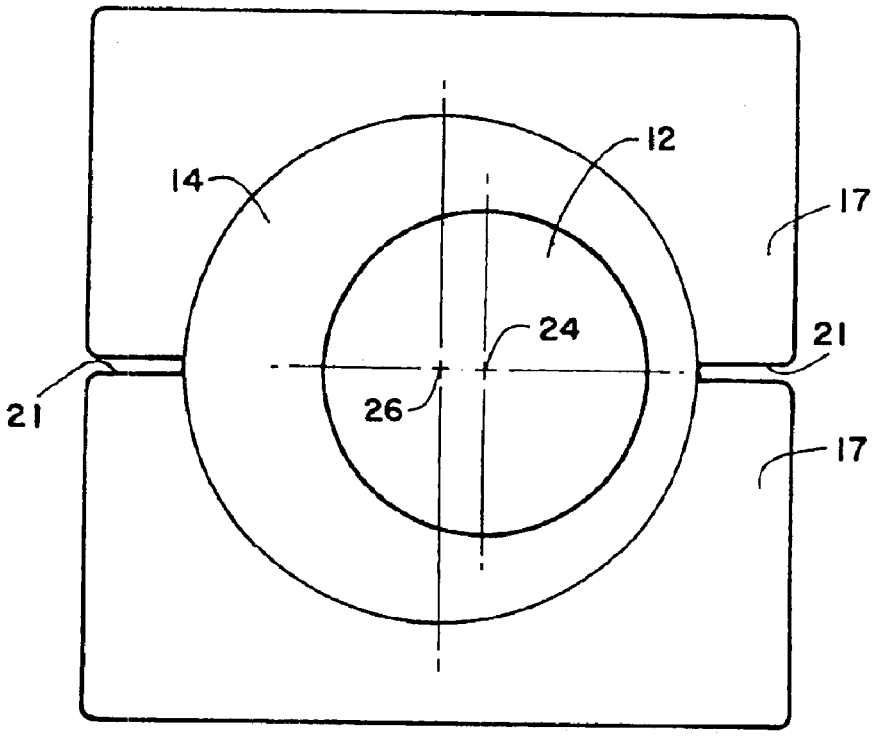
FIG. 4 depicts the cooperating aperture holding the rotating center tile in two pieces.

Finally as shown in FIG. 4, the surrounding section 16 could be formed of a plurality of individual sections 17 with the formed opening 20 cut into a side edge 21 of two or more of the sections 17. This option would work well with both the pre manufactured embodiment where the various components are provided in the proper color and texture to match or look good with the finished surface 42 surrounding the device 10 which may be the same color and texture if a match is desired or might be varied in color or texture such as plain white should a match not be desired or required or should the device be produced in a standard configuration and color for use with a plurality of different colors or textures of the surrounding finish surface 42.

The device herein shown in the drawings and described in detail herein disclose-arrangements of elements of particular construction and configuration for illustrating preferred embodiments of structure and method of operation and manufacture of the present invention. It is to be understood, however, that elements of different construction and configuration and other arrangements thereof, other than those illustrated and described, may be employed for providing a three directional adjustable hinge in accordance with the spirit of this invention, and such changes, alternations and modifications as would occur to those skilled in the art are considered to be within the scope of this invention as broadly defined in the appended claims.

As such, while the present invention has been described herein with reference to particular embodiments thereof, a latitude of modifications, various changes and substitutions are intended in the foregoing disclosure, and will be appreciated that in some instance some features of the invention will be employed without a corresponding use of other features without departing from the scope of the invention as set forth in the following claims.

What is claimed is:

1. An apparatus for alignment of underlying slab-mounted drain apertures with overlying drain openings in finished surfaces comprising:

a substantially planar center section having a top surface and a substantially planar bottom surface, a perimeter edge; and a center axis running therethrough;

said center section having a drain opening communicating between said top surface and said bottom surface, said drain opening having a central axis;

said drain opening positioned in said center section such that said center axis of said center section is spaced from said central axis of said drain aperture;

a substantially planar surface layer having a substantially planar bottom surface and substantially planar top surface, said surface layer adapted for overlay upon a substantially planar slab surface extending continuously outward from a substantially flush mounted drain aperture, a formed opening, said formed opening defined by a cutout in a surrounding section of said surface layer communicating between said top surface and said bottom surface of said surface layer;

said perimeter edge of said center section dimensioned to engage within said formed opening; and said center section rotatable when positioned within said formed opening with said bottom surface of said center section and said bottom surface of said surface layer both supported by said slab surface, to thereby position said drain opening substantially inline with said drain aperture, whereafter said bottom surface of said center section is affixable to said slab surface in a substantially contiguous mount.

2. The apparatus for alignment of underlying drain apertures with overlying drain openings in finished surfaces of claim 1 further comprising:

said surrounding section having a top side, a substantially flat bottom side adapted for overlay on top said slab surface, and an outside edge perimeter defining a shape, said shape dimensioned for insertion into a similarly dimensioned slightly larger opening in said surface area, whereby said surrounding section may be positioned in said opening in said surface area and said center section may be engaged within said formed opening and both said surrounding section and said center section may be rotated to line up said drain opening with said drain aperture.

3. The apparatus for alignment of underlying drain apertures with overlying drain openings in finished surfaces of claim 2 further comprising:

said surrounding section is rotatable to a plurality of mounting positions engaged with said opening in said surface area.

4. The apparatus for alignment of underlying drain apertures with overlying drain openings in finished surfaces of claim 1 further comprising:

said center section being circular in shape and said formed opening formed in said surrounding section being circular in shape.

5. The apparatus for alignment of underlying drain apertures with overlying drain openings in finished surfaces of claim 2 further comprising:

said center section being circular in shape and said formed opening formed in said surrounding section being circular in shape.

6. The apparatus for alignment of underlying drain apertures with overlying drain openings in finished surfaces of claim 3 further comprising:

said center section being circular in shape and said formed opening formed in said surrounding section being circular in shape.

7. The apparatus for alignment of underlying drain apertures with overlying drain openings in finished surfaces of claim 6 further comprising:

said surrounding section being round in shape.

8. The apparatus for alignment of underlying drain apertures with overlying drain openings in finished surfaces of claim 6 further comprising:

said surrounding section being rectangular in shape.

9. The apparatus for alignment of underlying drain apertures with overlying drain openings in finished surfaces of claim 1 further comprising:

said top surface of said center section being concave in shape.

10. The apparatus for alignment of underlying drain apertures with overlying drain openings in finished surfaces of claim 2 further comprising:

said top surface of said center section being concave in shape.

11. The apparatus for alignment of underlying drain apertures with overlying drain openings in finished surfaces of claim 1 further comprising:

said top side of said surrounding section being concave in shape.

12. The apparatus for alignment of underlying drain apertures with overlying drain openings in finished surfaces of claim 10 further comprising:

said top side of said surrounding section being concave in shape.

13. The apparatus for alignment of underlying drain apertures with overlying drain openings in finished surfaces of claim 1 further comprising:

said top surface of said center section being concave in shape.

14. The apparatus for alignment of underlying drain apertures with overlying drain openings in finished surfaces of claim 1 further comprising:

said center section being one of a kit of said center sections;

each center axis of said center sections being distanced a different amount from said center point; and whereby a user may chose one member of said kit of planar components with said drain aperture distanced an amount to allow said drain aperture to rotate to a position substantially in line with said underlying drain when said inner planer component is rotated.

15. The apparatus for alignment of underlying drain apertures with overlying drain openings in finished surfaces of claim 2 further comprising:

said center section being one of a kit of said center sections;

each center axis of said center sections being distanced a different amount from said center point; and whereby a user may chose one member of said kit of planar components with said drain aperture distanced an amount to allow said drain aperture to rotate to a position substantially in line with said underlying drain when said inner planer component is rotated.

16. The apparatus for alignment of underlying drain apertures with overlying drain openings in finished surfaces of claim 2 further comprising:

said center section being one of a kit of said center sections;

each center axis of said center sections being distanced a different amount from said center point;

said surrounding section being one of a kit of said surrounding sections having said formed opening in a different position; and whereby a user may chose one member of said kit of surrounding sections with said formed opening in the desired location and chose one member of said kit of planar components with said drain aperture distanced an amount to allow said drain aperture to rotate to a position substantially in line with said underlying drain when said inner planer component is rotated in place in said formed opening with said surrounding section in place in said finished surface.

17. A method for alignment of conduit apertures flush mounted with a continuously extending planar slab top surface of a surrounding slab, with a drain hole communicating through a substantially flat finished surface material layer overlayed on the slab top surface of said slab, comprising the steps of:

forming an inner planar component having a top surface, and having a substantially flat bottom surface adapted for contiguous engagement upon the substantially planar slab top surface continuously extending outward from said conduit aperture, and having a perimeter edge, and an having an off center drain aperture communicating between said top surface and said bottom surface; forming an opening in the finished surface material layer, sized to engage said perimeter of said inner planar component;

positioning said surface material layer upon said top surface of said slab with a said bottom surface of said surface material layer supported by said top surface of said slab and with said opening surrounding the flush mounted conduit aperture and a portion of said top surface of said slab extending from said conduit aperture and under said bottom surface of said surface material layer;

manipulating said inner planar component until said drain aperture is in line with said conduit aperture and said perimeter edge is aligned with said opening;

placing said inner planar component into said opening with said bottom surface of said inner planar component supported by said top surface of said slab; and fixing said inner planar component into position within said opening.

18. A method for alignment of underlying drains having drain apertures in flush communication with a substantially planar slab top surface of a surrounding slab continuously extending horizontally from the communication of said conduit aperture with said slab top surface, with a drain hole in a finished surfaces layer overlayed on said slab top surface of said slab, comprising the steps of:

forming an inner planar component having a top surface, and having a substantially flat bottom surface adapted for contiguous engagement upon the substantially planar slab top surface continuously extending outward from said conduit aperture, and having a perimeter edge, and an having an off center drain aperture communicating between said top surface and said bottom surface;

forming a surrounding planar component having top side a planar bottom side adapted for engagement upon said planar slab top surface and dimensioned to fit within an aperture formed in a finished surface layer engaged upon the substantially planar slab surface extending continuously from said conduit aperture flush mounted in said slab;

forming a passageway in said surrounding planar component, said passageway communicating between said top side and said bottom side of said surrounding planar component, said passageway sized to engage said perimeter edge of said inner planar component;

placing said surrounding planar component within said aperture and supported by contact of its bottom side engaged upon said slab too surface;

manipulating said inner planar component until said drain aperture is in line with said underlying conduit aperture and said perimeter edge is in line with said passageway;

placing said inner planar component into said passageway with said bottom surface of said inner planar component supported by said slab top surface; and fixing said inner planar component in position in said passageway.

* * * * *